US010704152B2

(12) United States Patent
Holland et al.

(10) Patent No.: US 10,704,152 B2
(45) Date of Patent: Jul. 7, 2020

(54) METHODS AND SYSTEMS FOR PRODUCING A METAL CHLORIDE OR THE LIKE

(71) Applicant: Consolidated Nuclear Security, LLC, Oak Ridge, TN (US)

(72) Inventors: Justin M. Holland, Clinton, TN (US); John W. Freiderich, Oak Ridge, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 178 days.

(21) Appl. No.: 15/868,464

(22) Filed: Jan. 11, 2018

(65) Prior Publication Data

US 2019/0211460 A1 Jul. 11, 2019

(51) Int. Cl.
*C25B 1/26* (2006.01)
*C25B 9/06* (2006.01)
(Continued)

(52) U.S. Cl.
CPC ..... *C25B 1/26* (2013.01); *C25B 1/14* (2013.01); *C25B 9/00* (2013.01); *C25B 9/04* (2013.01);
(Continued)

(58) Field of Classification Search
CPC ..... C25B 1/24; C25B 1/245; C25B 1/26
(Continued)

(56) References Cited

U.S. PATENT DOCUMENTS 1,343,662 A * 6/1920 Danckwardt ..... C01F 7/58 423/496
2,870,072 A * 1/1959 Merlub-Sobel ..... C25C 3/02 205/359

(Continued)

OTHER PUBLICATIONS

Chandler, H.W. and Malgiolio, J., Preparation of High Purity Anhydrous Ferrous Chloride. Technical Report No. ASD-TDR-62-1040, 1963.

*Primary Examiner* — Harry D Wilkins, III
(74) *Attorney, Agent, or Firm* — Clements Bernard Walker; Christopher L. Bernard

(57) ABSTRACT

Systems and methods for producing metal chloride $M^{I}Cl_x$ from metal $M^{I}$ without the use of HCl and/or $Cl_2$ gases, including: a bath vessel holding conductive fluid; an anode disposed in the conductive fluid, the anode including metal $M^{I}$; a cathode assembly disposed in the conductive fluid, the cathode assembly including a cathode vessel including porous and non-porous portions, the non-porous portion holding sacrificial metal chloride $M^{II}Cl_y$ substantially separate from metal chloride $M^{I}Cl_x$, wherein the cathode assembly includes a center lead disposed within the cathode vessel operable for delivering charge to sacrificial metal chloride $M^{II}Cl_y$; and a power supply coupling the anode and the cathode assembly, the power supply polarized to produce current flow in a direction that causes anodic dissolution of metal $M^{I}$ into the conductive fluid and deposition of metal $M^{II}$ within the cathode vessel. The systems and methods apply equally to producing metal halide $M^{I}X_x$.

23 Claims, 2 Drawing Sheets

(51) Int. Cl.

| | |
|---|---|
| ***C25B 9/00*** | (2006.01) |
| ***C25B 1/14*** | (2006.01) |
| ***C25B 15/08*** | (2006.01) |
| ***C25B 11/03*** | (2006.01) |
| ***C25B 9/04*** | (2006.01) |
| ***C25C 1/20*** | (2006.01) |
| *C25C 3/34* | (2006.01) |

(52) U.S. Cl.
CPC ..... *C25B 9/063* (2013.01); *C25B 11/035* (2013.01); *C25B 15/08* (2013.01); *C25C 1/20* (2013.01); *C25C 3/34* (2013.01)

(58) Field of Classification Search
USPC ..... 205/359
See application file for complete search history.

(56) References Cited

U.S. PATENT DOCUMENTS

| | | | | |
|---|---|---|---|---|
| 2,941,931 | A * | 6/1960 | Dean | C01G 25/04 205/359 |
| 4,264,569 | A | 4/1981 | Sinha | |
| 4,279,705 | A * | 7/1981 | Riggs, Jr. | C25B 1/00 205/46 |
| 4,846,943 | A * | 7/1989 | Coetzer | C25B 1/26 205/359 |
| 5,250,276 | A | 10/1993 | Knuuttila et al. | |
| 6,235,183 | B1 * | 5/2001 | Putter | C25C 3/02 205/359 |
| 6,800,262 | B1 | 10/2004 | Miller et al. | |
| 7,267,754 | B1 * | 9/2007 | Willit | C25C 3/34 205/46 |
| 8,475,756 | B1 | 7/2013 | Westphal et al. | |
| 9,039,885 | B1 | 5/2015 | Holland et al. | |
| 9,856,569 | B2 * | 1/2018 | Bhavaraju | C25C 1/22 |
| 2014/0178796 | A1 * | 6/2014 | Ueda | C25B 1/24 429/498 |

* cited by examiner

METHODS AND SYSTEMS FOR PRODUCING A METAL CHLORIDE OR THE LIKE

STATEMENT REGARDING FEDERALLY SPONSORED RESEARCH AND/OR DEVELOPMENT

The U.S. Government has certain rights to the present disclosure pursuant to Contract No. DE-NA0001942 between the U.S. Department of Energy and Consolidated Nuclear Security, LLC.

FIELD OF THE DISCLOSURE

The present disclosure relates generally to methods and systems for producing an anhydrous metal chloride, $M^ICl_x$. More specifically, the present disclosure relates to methods and systems for producing an anhydrous metal chloride, $M^ICl_x$, directly from a metal, $M^I$, in a molten chloride bath without the use of HCl and/or $Cl_2$ gases. Further, means are provided to control the valence state, $M^{I\ x+}$, of the product salt.

BACKGROUND OF THE DISCLOSURE

The production of an anhydrous metal chloride, $M^ICl_x$., typically requires the use of HCl and/or $Cl_2$ gases, both of which are highly reactive and toxic. The hazardous nature of these gases often demands significant capital investments in processing equipment and controls. Metal chlorides can sometimes be produced using safer aqueous techniques, but it is sometimes problematic to obtain anhydrous salts using such techniques.

Thus, what is still needed in the art is a novel approach to produce an anhydrous metal chloride, $M^ICl_x$, particularly when the desired application for the metal chloride, $M^ICl_x$, involves a molten salt process, such as electrorefining, electrodeposition, electrowinning, and/or electropolishing. Preferably, pure anhydrous halide salts can also be obtained by adding a sublimation step to the approach. Further, it is desirable that the valence state of the metal, $M^{I\ x+}$, forming the metal chloride, $M^ICl_x$, can be controlled by electrochemical means.

BRIEF SUMMARY OF THE DISCLOSURE

In various exemplary embodiments, the present disclosure provides a novel approach to produce an anhydrous metal chloride, $M^ICl_x$, particularly when the desired application for the metal chloride, $M^ICl_x$, involves a molten salt process, such as electrorefining, electrodeposition, electrowinning, and/or electropolishing. Pure anhydrous halide salts can also be obtained by adding a sublimation step to the approach. Further, the valence state of the metal, $M^{I\ x+}$, forming the metal chloride, $M^ICl_x$, can be controlled by electrochemical means.

In one exemplary embodiment, the present disclosure provides a system for producing a metal chloride $M^ICl_x$ from a metal $M^I$ without the use of HCl and/or $Cl_2$ gases, the system including: a bath vessel holding a conductive fluid; an anode disposed in the conductive fluid, wherein the anode includes metal $M^I$; a cathode assembly disposed in the conductive fluid, wherein the cathode assembly includes a cathode vessel including a porous portion and a non-porous portion, the non-porous portion holding a sacrificial metal chloride $M^{II}Cl_y$ substantially separate from the metal chloride $M^ICl_x$, and wherein the cathode assembly includes a center lead disposed within the cathode vessel operable for delivering charge to the sacrificial metal chloride $M^{II}Cl_y$; and a power supply coupling the anode and the cathode assembly, wherein the power supply is polarized to produce current flow in a direction that causes anodic dissolution of metal $M^I$ into the conductive fluid and deposition of a metal $M^{II}$ within the cathode vessel. The conductive fluid includes one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$, and $InCl_3$. The metal $M^I$ includes one or more of an alkali metal, an alkaline earth metal, a transition metal (e.g., Ti, Mn, Fe, Ni, Zr), a metalloid (e.g., Al, Ga, In, Sn), a lanthanide, and an actinide, and the derived metal chloride $M^ICl_x$ includes a corresponding metal chloride. The sacrificial metal chloride $M^{II}Cl_y$ includes one or more of a precious metal chloride (e.g., AgCl, $PtCl_2$, AuCl, $PdCl_2$), a transition metal chloride (e.g., $ZnCl_2$, $FeCl_2$, $CuCl_2$, $MnCl_2$), a lanthanide chloride (e.g., $CeCl_4$, $PrCl_4$), and an actinide chloride, and the metal $M^{II}$ includes a corresponding metal. Preferably, the reduction potential of the sacrificial metal chloride $M^{II}Cl_y$ is more noble than the reduction potential of the metal chloride $M^ICl_x$. Optionally, the cathode vessel includes a porous upper portion and a non-porous lower portion. The non-porous lower portion of the cathode vessel includes a conductive crucible. The system also includes an inert anode that selectively replaces the anode to adjust a valence state of the metal chloride $M^ICl_x$ to a higher value. As used herein, the "conductive fluid" may be a molten salt (e.g., LiCl, KCl), an ionic liquid (e.g., 1-butyl-3-methylimidazolium chloride), a deep eutectic solvent (e.g., two parts malonic acid to one part urea), an organic solvent with a charge carrier (e.g., ethylene carbonate with lithium hexafluorophosphate), etc.

In another exemplary embodiment, the present disclosure provides a method for producing a metal chloride $M^ICl_x$ from a metal $M^I$ without the use of HCl and/or $Cl_2$ gases, the method including: providing a bath vessel holding a conductive fluid; disposing an anode in the conductive fluid, wherein the anode includes metal $M^I$; disposing a cathode assembly in the conductive fluid, wherein the cathode assembly includes a cathode vessel including a porous portion and a non-porous portion, the non-porous portion holding a sacrificial metal chloride $M^{II}Cl_y$ substantially separate from the metal chloride $M^ICl_x$, and wherein the cathode assembly includes a center lead disposed within the cathode vessel operable for delivering charge to the sacrificial metal chloride $M^{II}Cl_y$; and providing a power supply coupling the anode and the cathode assembly, wherein the power supply is polarized to produce current flow in a direction that causes anodic dissolution of metal $M^I$ into the conductive fluid and deposition of a metal $M^{II}$ within the cathode vessel. The conductive fluid includes one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$, and $InCl_3$. The metal $M^I$ includes one or more of an alkali metal, an alkaline earth metal, a transition metal (e.g., Ti, Mn, Fe, Ni, Zr), a metalloid (e.g., Al, Ga, In, Sn), a lanthanide, and an actinide, and the derived metal chloride $M^ICl_x$ includes a corresponding metal chloride. The sacrificial metal chloride $M^{II}Cl_y$ includes one or more of a precious metal chloride (e.g., AgCl, $PtCl_2$, AuCl, $PdCl_2$), a transition metal chloride (e.g., $ZnCl_2$, $FeCl_2$, $CuCl_2$, $MnCl_2$), a lanthanide chloride (e.g., $CeCl_4$, $PrCl_4$), and an actinide chloride, and the metal $M^{II}$ includes a corresponding metal. Preferably, the reduction potential of the sacrificial metal chloride $M^{II}Cl_y$ is more noble than the reduction potential of the metal chloride $M^ICl_x$. Optionally, the cathode vessel includes a porous upper portion and a non-porous lower portion. The non-porous lower portion of the cathode vessel includes a conductive crucible. The method also includes selectively replacing the anode with an inert anode to adjust a valence state of the metal chloride $M^ICl_x$ to a higher value. Optionally, the method further includes using the metal chloride $M^ICl_x$ and the conductive fluid to transport metal from an anode to a cathode in an electrorefiner. Alternatively, the method further includes separating the metal chloride $M^ICl_x$ from the conductive fluid by sublimation. Finally, if the sacrificial metal chloride $M^{II}Cl_y$ is AgCl, the method still further includes recycling the cathode assembly for subsequent use. Recycling the cathode assembly for subsequent use includes performing aqueous dissolution of silver in nitric acid, precipitation and drying of silver chloride by thermal purification, and reusing the silver chloride in the cathode assembly to produce additional metal chloride $M^ICl_x$. Again, as used herein, the "conductive fluid" may be a molten salt (e.g., LiCl, KCl), an ionic liquid (e.g., 1-butyl-3-methylimidazolium chloride), a deep eutectic solvent (e.g., two parts malonic acid to one part urea), an organic solvent with a charge carrier (e.g., ethylene carbonate with lithium hexafluorophosphate), etc.

In a further exemplary embodiment, the present disclosure provides a system for producing a metal halide $M^IX_x$ from a metal $M^I$, the system including: a bath vessel holding a conductive fluid; an anode disposed in the conductive fluid, wherein the anode includes metal $M^I$; a cathode assembly disposed in the conductive fluid, wherein the cathode assembly includes a cathode vessel including a porous portion and a non-porous portion, the non-porous portion holding a sacrificial metal halide $M^{II}X_y$ substantially separate from the metal halide $M^IX_x$, and wherein the cathode assembly includes a center lead disposed within the cathode vessel operable for delivering charge to the sacrificial metal halide $M^{II}X_y$; and a power supply coupling the anode and the cathode assembly, wherein the power supply is polarized to produce current flow in a direction that causes anodic dissolution of metal $M^I$ into the conductive fluid and deposition of a metal $M^{II}$ within the cathode vessel. Preferably, the reduction potential of the sacrificial metal halide $M^{II}X_y$ is more noble than the reduction potential of the metal halide $M^IX_x$. The cathode vessel includes a porous upper portion and a non-porous lower portion. The non-porous lower portion of the cathode vessel includes a conductive crucible. The system also includes an inert anode that selectively replaces the anode to adjust a valence state of the metal halide $M^IX_x$ to a higher value.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

Figure 1:
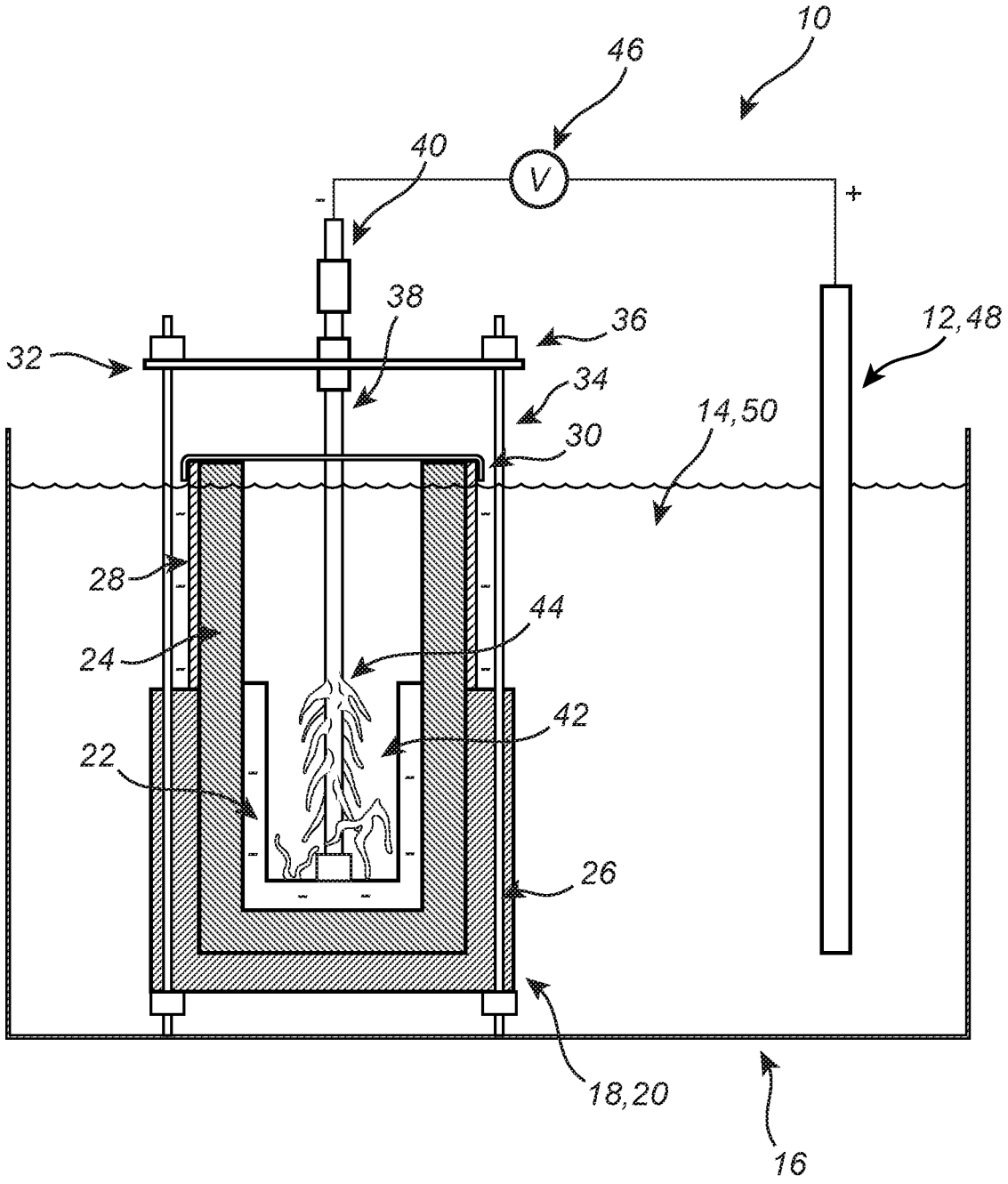
FIG. 1 is schematic diagram illustrating one exemplary embodiment of the system/method for producing an anhydrous metal chloride, $M^ICl_x$, of the present disclosure.

Referring now specifically to FIG. 1, in one exemplary embodiment, the present disclosure provides a system/method 10 for producing an anhydrous metal chloride, $M^ICl_x$, directly from a metal, $M^I$, in a molten chloride bath without the use of corrosive HCl and/or $Cl_2$ gases. An anode 12 constructed from the same metal, $M^I$, as desired in the metal chloride, $M^ICl_x$, product is dissolved in a molten salt medium 14 (e.g., LiCl, KCl) disposed in a bath vessel 16 or the like. It will be readily apparent to those of ordinary skill in the art that this molten salt medium 14 may be generalized to any conductive fluid, such as an ionic liquid (e.g., 1-butyl-3-methylimidazolium chloride), a deep eutectic solvent (e.g., two parts malonic acid to one part urea), an organic solvent with a charge carrier (e.g., ethylene carbonate with hexafluorophosphate), etc. A cathode assembly 18 is also disposed in the molten salt medium 14. The cathode assembly 18 includes a partially porous vessel 20 formed from a conductive crucible 22, such as a conductive steel crucible or the like, disposed within the lower portion of a porous crucible 24, such as a porous SiC crucible or the like. The lower portion of the porous crucible 24 is disposed within a fluid tight crucible 26, such as a fluid tight SiC crucible or the like. The upper portion of the porous crucible 24 is optionally disposed within a porous cylinder 28 or the like that is coupled to the fluid tight crucible 26. This porous cylinder 28 may include a steel mesh, a perforated steel plate, a fiber metal felt, or the like that acts as a secondary cathode that minimizes the transport out of the cathode assembly 18. The upper portion of the partially porous vessel 20 is closed with a lid 30, such as a steel lid or the like, and is hung within the bath vessel 16 from a ceramic plate 32 or the like by a plurality of threaded rods 34 and hex nuts 36, for example. It will be readily apparent to those of ordinary skill in the art that any other suitable retention mechanisms may be used equally. Accordingly, the partially porous vessel 20 allows for transport through its upper portion, while preventing transport through its lower portion. A center lead 38 coupled to a pipe coupling 40 or the like is disposed through the ceramic plate 32 and lid 30 and protrudes into the interior of the partially porous vessel 20, coextensive with the porous and non-porous portions of the partially porous vessel 20. The center lead 38 is operable for delivering charge to a second melt 42 containing a sacrificial metal chloride, $M^{II}Cl_y$, disposed within the interior of the partially porous vessel 20. The second melt 42 may be any conveniently available anhydrous chloride having a reduction potential more noble than that of $M^ICl_x$. $M^{II}$ 44 is deposited on the center lead 38 during the corresponding reaction. A particularly good exemplary choice for $M^{II}Cl_y$ is AgCl because it is readily available in anhydrous form, has a noble reduction potential, and can potentially be recycled as described in greater detail herein below. Other chlorides can also be used for $M^{II}Cl_y$ (e.g., $ZnCl_2$, $FeCl_2$), depending on the metal chloride being produced. These latter chlorides are not as readily recycled as AgCl, but they may find use when the metal chloride product value is substantially higher (e.g., actinide and rare earth chlorides) than the metal contained in the sacrificial chloride salt.

To produce the desired metal chloride, $M^ICl_x$, a DC power supply 46 is connected between the anode 12 and the cathode assembly 18 and polarized to produce current flow in a direction that causes anodic dissolution of $M^I$ into the supporting molten salt medium 14 and the deposition of $M^{II}$ at the inner wall of the conductive crucible 22 and the center lead 38 of the cathode assembly 18. The secondary cathode of the porous cylinder 28 is coupled to the power supply 46 via the lid 30, for example. The cathode assembly 18 is constructed such that the migration of $M^{II}Cl_y$ into the supporting molten salt medium 14 is minimized, thereby avoiding cross-contamination concerns and process inefficiency. After the metal anode 12 has been dissolved to a desired extent, the valence state of the $M^ICl_x$ may be adjusted to higher values by removing the $M^I$ anode 12 and replacing it with an inert anode 48 (e.g., Pt, graphite). So long as the reduction potential of the targeted valence state of $M^ICl_x$ does not exceed that of $M^{II}Cl_y$ in the cathode assembly 18, or the potential at which $Cl_2$ gas is produced, the DC power supply 46 can be used to oxidize $M^I$ to the desired valence state. Once the cell current begins to decay to zero at a constant anode potential, the conversion of $M^I$ to a higher valence state can be considered to be complete.

Figure 2:
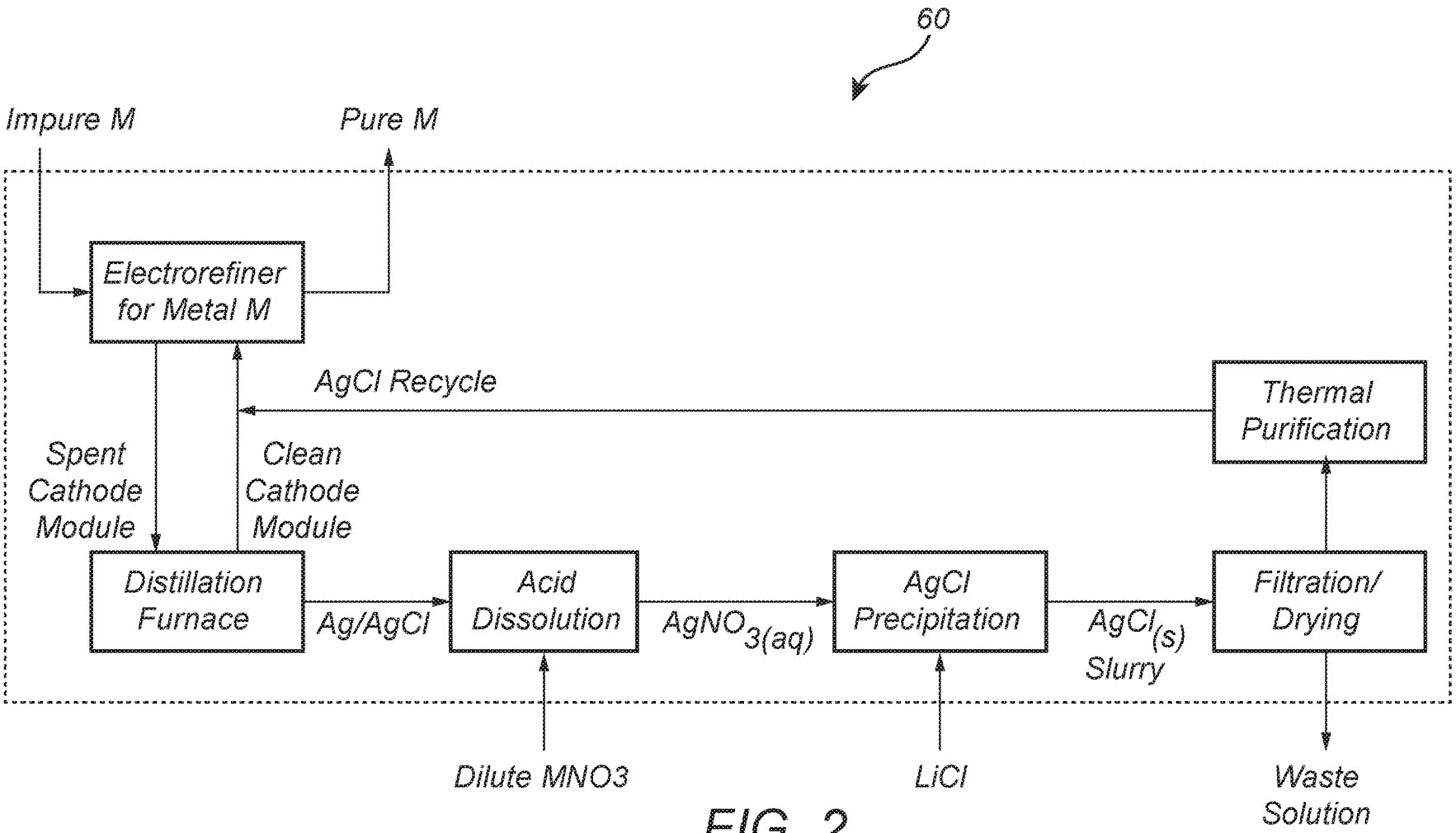
FIG. 2 is a schematic diagram illustrating one exemplary embodiment of a system/method for recycling a cathode assembly used in the system/method for producing an anhydrous metal chloride, $M^ICl_x$, of the present disclosure.

Referring now specifically to FIG. 2, in one exemplary embodiment, upon completion of $M^ICl_x$ production/valence adjustment, the cathode assembly 18 can be removed from the molten salt bath 14 and either disposed or, when AgCl is used as the sacrificial metal chloride, recycled for repeated use. The process 60 used to recycle the AgCl relies on the aqueous dissolution of silver in nitric acid followed by the precipitation and drying of AgCl. After drying, which preferably includes a thermal purification step, the AgCl can be reused in the cathode assembly 18 to produce additional $M^ICl_x$.

The product chloride salt, $M^ICl_x$, 50, as shown in FIG. 1, can be recovered from the supporting molten salt medium 14 by means of sublimation, or can be used as is, depending on the desired application of the product chloride salt, $M^ICl_x$, 50. For example, if the desired application is to use the metal chloride 50 to transport metal from anode to cathode in an electrorefiner, then the salt mixture 14, 50 can likely be used as is, without requiring any additional processing. This decision can be made by those of ordinary skill in the art.

In general, by way of example, anhydrous aluminum chloride is finding increasing use as a low temperature molten salt bath when mixed with other metal chlorides. The process for producing anhydrous $AlCl_3$, described by Sinha in U.S. Pat. No. 4,264,569, relies on a complicated dehydration process involving high temperatures and a gas mixture containing carbon monoxide and chlorine. The present disclosure, however, provides an alternative path to obtaining anhydrous $AlCl_3$ that does not rely on these hazardous gases.

Similarly, in U.S. Pat. No. 8,475,756, Westphal describes a method for preparing pure anhydrous $UCl_3$ for use in a molten salt electrorefiner. This method relies on the direct reaction of uranium metal with a metal chloride, such as $CuCl_2$, followed by high temperature distillation to recover the $UCl_3$. Although this method avoids the use of hazardous gases, it is not an in situ method. In contrast, the method of the present disclosure provides a means of preparing the metal chloride in situ, eliminating the need for separate processing. Although U.S. Pat. No. 6,800,262 describes an in situ process for producing $UCl_3$ in an electrorefiner, it requires a pool of liquid cadmium metal and gaseous chlorine, both of which are highly toxic and hazardous. Another in situ method is described by Holland and Cecala in U.S. Pat. No. 9,039,885, but this method relies on the use of hazardous HCl gas. Again, the present method does not rely on these hazardous substances.

Likewise, anhydrous ferric chloride is used as a drying agent and oxidant in various reactions. Knuuttila describes a method for its preparation in U.S. Pat. No. 5,250,276 that utilizes hydrogen peroxide to oxidize iron to the 3+ valence state in aqueous solution, followed by a number of drying steps conducted in an HCl atmosphere. In contrast, the present disclosure provides a means for producing a $Fe^{2+}$ molten salt solution that could be further oxidized to $Fe^{3+}$ without requiring HCl gas. The anhydrous $FeCl_3$ could then be recovered by distillation.

The proposed implementation of the present disclosure is for the production of anhydrous metal chlorides, but it is readily extendable to other halide salts (e.g., fluoride, bromide, and iodide). To produce other halides, it is important to match the halide in the main salt bath (e.g., LiI for production of metal iodides), as well as the halide in the cathode compartment. The salts chosen for producing halides other than chlorides may impose different operating conditions on the process (e.g., lower temperatures for iodides). Anions other than halides may also be used to produce a metal salt including, but not limited to, trifluoromethanesulfone, bis(trifluoromethane sulfonyl) imide, tetrafluorob orate, hexafluorophosphate, nitrate, perchlorate, sulfate, carbonate, hydroxide, or hexafluoroantinate.

In general, the present disclosure is beneficial to the molten salt electrorefining industry, as it provides a convenient in situ method for producing the metal chloride species used in electrorefiners. Further, any industries involved in the production of pure anhydrous metal chlorides may find this method useful.

Although the present disclosure is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following non-limiting claims for all purposes.

What is claimed is:

1. A system for producing a metal chloride $M^ICl_x$ from a metal $M^I$ without the use of HCl and/or $Cl_2$ gases, the system comprising:

a bath vessel holding a conductive fluid;

an anode disposed in the conductive fluid, wherein the anode comprises metal $M^I$;

a cathode assembly disposed in the conductive fluid, wherein the cathode assembly comprises a cathode vessel comprising a porous portion and a non-porous portion, the non-porous portion holding a sacrificial metal chloride $M^{II}Cl_y$ substantially separate from the metal chloride $M^ICl_x$, and wherein the cathode assembly comprises a center lead disposed within the cathode vessel operable for delivering charge to the sacrificial metal chloride $M^{II}Cl_y$; and a power supply coupling the anode and the cathode assembly, wherein the power supply is polarized to produce current flow in a direction that causes anodic dissolution of metal $M^I$ into the conductive fluid and deposition of a metal $M^{II}$ within the cathode vessel;

wherein a reduction potential of the sacrificial metal chloride $M^{II}Cl_y$ is more noble than a reduction potential of the metal chloride $M^ICl_x$.

2. The system of claim 1, wherein the conductive fluid comprises one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$, and $InCl_3$.

3. The system of claim 1, wherein the metal $M^I$ comprises one or more of an alkali metal, an alkaline earth metal, a transition metal, a metalloid, a lanthanide, and an actinide, and the metal chloride $M^ICl_x$ includes a corresponding metal chloride.

4. The system of claim 1, wherein the sacrificial metal chloride $M^{II}Cl_y$ comprises one or more of a precious metal chloride, a transition metal chloride, a lanthanide chloride, and an actinide chloride, and the metal $M^{II}$ includes a corresponding metal.

5. The system of claim 1, wherein the cathode vessel comprises a porous upper portion and a non-porous lower portion.

6. The system of claim 5, wherein the non-porous lower portion of the cathode vessel comprises a conductive crucible.

7. The system of claim 1, further comprising an inert anode that selectively replaces the anode to adjust a valence state of the metal chloride $M^{I}Cl_x$ to a higher value.

8. A method for producing a metal chloride $M^{I}Cl_x$ from a metal $M^{I}$ without the use of HCl and/or $Cl_2$ gases, the method comprising:

providing a bath vessel holding a conductive fluid;

disposing an anode in the conductive fluid, wherein the anode comprises metal $M^{I}$;

disposing a cathode assembly in the conductive fluid, wherein the cathode assembly comprises a cathode vessel comprising a porous portion and a non-porous portion, the non-porous portion holding a sacrificial metal chloride $M^{II}Cl_y$ substantially separate from the metal chloride $M^{I}Cl_x$, and wherein the cathode assembly comprises a center lead disposed within the cathode vessel operable for delivering charge to the sacrificial metal chloride $M^{II}Cl_y$; and providing a power supply coupling the anode and the cathode assembly, wherein the power supply is polarized to produce current flow in a direction that causes anodic dissolution of metal $M^{I}$ into the conductive fluid and deposition of a metal $M^{II}$ within the cathode vessel;

wherein a reduction potential of the sacrificial metal chloride $M^{II}Cl_y$ is more noble than a reduction potential of the metal chloride $M^{I}Cl_x$.

9. The method of claim 8, wherein the conductive fluid comprises one or more of LiCl, NaCl, KCl, RbCl, CsCl, $MgCl_2$, $CaCl_2$, $SrCl_2$, $BaCl_2$, $ZnCl_2$, $SnCl_4$, $AlCl_3$, $GaCl_3$, and $InCl_3$.

10. The method of claim 8, wherein the metal $M^{I}$ comprises one or more of an alkali metal, an alkaline earth metal, a transition metal, a metalloid, a lanthanide, and an actinide, and the metal chloride $M^{I}Cl_x$ includes a corresponding metal chloride.

11. The method of claim 8, wherein the sacrificial metal chloride $M^{II}Cl_y$ comprises one or more of a precious metal chloride, a transition metal chloride, a lanthanide chloride, and an actinide chloride, and the metal $M^{II}$ includes a corresponding metal.

12. The method of claim 8, wherein the cathode vessel comprises a porous upper portion and a non-porous lower portion.

13. The method of claim 12, wherein the non-porous lower portion of the cathode vessel comprises a conductive crucible.

14. The method of claim 8, further comprising selectively replacing the anode with an inert anode to adjust a valence state of the metal chloride $M^{I}Cl_x$ to a higher value.

15. The method of claim 8, further comprising using the metal chloride $M^{I}Cl_x$ and the conductive fluid to transport metal from an anode to a cathode in an electrorefiner.

16. The method of claim 8, further comprising separating the metal chloride $M^{I}Cl_x$ from the conductive fluid by sublimation.

17. The method of claim 8, further comprising, if the sacrificial metal chloride $M^{II}Cl_y$ is AgCl, recycling the cathode assembly for subsequent use.

18. The method of claim 17, wherein recycling the cathode assembly for subsequent use comprises performing aqueous dissolution of silver in nitric acid, precipitation and drying of silver chloride by thermal purification, and reusing the silver chloride in the cathode assembly to produce additional metal chloride $M^{I}Cl_x$.

19. A system for producing a metal halide $M^{I}X_x$ from a metal $M^{I}$, the system comprising:

a bath vessel holding a conductive fluid;

an anode disposed in the conductive fluid, wherein the anode comprises metal $M^{I}$;

a cathode assembly disposed in the conductive fluid, wherein the cathode assembly comprises a cathode vessel comprising a porous portion and a non-porous portion, the non-porous portion holding a sacrificial metal halide $M^{II}X_y$ substantially separate from the metal halide $M^{I}X_x$, and wherein the cathode assembly comprises a center lead disposed within the cathode vessel operable for delivering charge to the sacrificial metal halide $M^{II}X_y$; and a power supply coupling the anode and the cathode assembly, wherein the power supply is polarized to produce current flow in a direction that causes anodic dissolution of metal $M^{I}$ into the conductive fluid and deposition of a metal $M^{II}$ within the cathode vessel;

wherein a reduction potential of the sacrificial metal halide $M^{II}X_y$ is more noble than a reduction potential of the metal halide $M^{I}X_x$.

20. The system of claim 19, wherein the cathode vessel comprises a porous upper portion and a non-porous lower portion.

21. The system of claim 20, wherein the non-porous lower portion of the cathode vessel comprises a conductive crucible.

22. The system of claim 19, further comprising an inert anode that selectively replaces the anode to adjust a valence state of the metal halide $M^{I}X_x$ to a higher value.

23. A method for producing a metal halide $M^{I}X_x$ from a metal $M^{I}$, the method comprising:

providing a bath vessel holding a conductive fluid;

disposing an anode in the conductive fluid, wherein the anode comprises metal $M^{I}$;

disposing a cathode assembly in the conductive fluid, wherein the cathode assembly comprises a cathode vessel comprising a porous portion and a non-porous portion, the non-porous portion holding a sacrificial metal halide $M^{II}X_y$ substantially separate from the metal halide $M^{I}X_x$, and wherein the cathode assembly comprises a center lead disposed within the cathode vessel operable for delivering charge to the sacrificial metal halide $M^{II}X_y$; and providing a power supply coupling the anode and the cathode assembly, wherein the power supply is polarized to produce current flow in a direction that causes anodic dissolution of metal $M^{I}$ into the conductive fluid and deposition of a metal $M^{II}$ within the cathode vessel;

wherein a reduction potential of the sacrificial metal halide $M^{II}X_y$ is more noble than a reduction potential of the metal halide $M^{I}X_x$.

* * * * *